US005194360A

United States Patent [19]

Ohmura et al.

[11] Patent Number: 5,194,360

[45] Date of Patent: Mar. 16, 1993

[54] METHOD OF PRODUCING A CARRIER FOR ELECTROSTATIC IMAGE DEVELOPER

[75] Inventors: Ken Ohmura, Hachioji; Kenji Tsujita, Fujino; Shigenori Kouno, Tachikawa, all of Japan

[73] Assignee: Konica Corporation, Tokyo, Japan

[21] Appl. No.: 675,275

[22] Filed: Mar. 26, 1991

[30] Foreign Application Priority Data

Apr. 17, 1990 [JP] Japan ..... 2-99385

[51] Int. Cl.[5] ..... G03G 9/00

[52] U.S. Cl. ..... 430/137; 430/108; 430/110; 427/127; 427/195; 427/201

[58] Field of Search ..... 430/137, 108, 110; 427/127, 195, 201

[56] References Cited

U.S. PATENT DOCUMENTS 4,524,119 6/1985 Luly et al. ..... 430/108

FOREIGN PATENT DOCUMENTS 51-64590 12/1976 Japan .

63-228174 9/1988 Japan ..... 430/137

*Primary Examiner*—Marion E. McCamish

*Assistant Examiner*—Christopher D. RoDee

*Attorney, Agent, or Firm*—Finnegan, Henderson, Farabow, Garrett and Dunner

[57] ABSTRACT

A method for producing a carrier for an electrostatic image developer is disclosed. The carrier comprises a core particle and a resin coating layer and is produced by a method comprising stirring a mixture of core particles, resin particles and particles of a carbon fluoride to form a resin coating layer on the surface of each core particle, the resin coating layer contains the carbon fluoride dispersed therein, in a ratio of from 5% to 45% by weight to the whole weight of the resin coat layer. A two-component developer using the carrier is improved in the durability.

6 Claims, 2 Drawing Sheets

METHOD OF PRODUCING A CARRIER FOR ELECTROSTATIC IMAGE DEVELOPER

FIELD OF THE INVENTION

The present invention relates to a method of producing a carrier for an electrostatic image developer comprising core particles each having a resin coat layer formed thereon.

BACKGROUND OF THE INVENTION

An electrophotographic two-component developer consists of a toner and a carrier, in which the carrier is used for the purpose of providing a proper polarity and a proper amount of triboelectric charge to the toner.

As the carrier, there is used a resin-coated carrier comprising a resin coat layer formed on the surface of each core material particle.

As for the resin-coated carrier there are conventionally known techniques shown below:

(1) The technique disclosed in Japanese Patent Examined Publication No. 48782/1982, in which a carbon fluoride-added fluororesin is used as a coating material for forming a resin coat layer on the carrier.

(2) The technique disclosed in Japanese Patent Publication Open to Public Inspection (hereinafter referred to as JP O.P.I.) No. 48050/1985, in which carbon fluoride is added as conductive particles to the resin coat layer of a carrier.

The incorporation of carbon fluoride into the resin coat layer as disclosed in the above techniques (1) and (2) enables to lower the surface energy of the carrier, so that a carrier causing less toner permanent welding of toner particles to the carrier surface can be obtained.

However, in a wet process which uses a coating liquid as a coating means, the aggregative power of carbon fluoride particles is so strong that it is considerably difficult for the particles to uniformly disperse in a state of primary particles in a coating liquid. Therefore the carbon fluoride particles are present in a secondary aggregate state in the coating liquid to thus have a very poor dispersion stability.

The poor dispersion stability of carbon fluoride particles in the coating liquid makes it difficult to handle the coating liquid and causes the carbon fluoride to disperse unevenly in the formed resin coat layer, and further worsen the adhesion of the coating resin to the carbon fluoride.

When such a carrier is used to form a number of image copies, since the carbon fluoride is liable to split from the resin coat layer, the characteristics of the carrier largely change with time to cause the carrier's durability to be insufficient.

The triboelectric charging with the toner depends largely upon the characteristics of the outermost surface of the resin-coated carrier, but even on the outermost surface of the carrier itself the coating resin and carbon fluoride are unevenly dispersed, so that the difference in the chargeability between the coating resin and the carbon fluoride makes the toner unable to be uniformly triboelectrically charged to result in charging trouble of the developer to allow an increased amount of counter polarity-having toner particles to be present to cause image defects such as a background fog and solid image density drop of a copied image.

SUMMARY OF THE INVENTION

It is an object of the invention to provide a method of producing a carrier for an electrostatic image developer having an excellent durability to keep on the initial characteristics thereof over a long period of time by remarkably improving the dispersibility of the carbon fluoride in the resin coat layer thereof.

The object of the invention is achieved by a method of producing a carrier for an electrostatic image developer comprising a step of stirring a mixture of core particles, resin particles and particles of a carbon fluoride to form a resin coating layer on the surface of each core particle. The resin coating layer contains the carbon fluoride dispersed therein, in a ratio of from 5 to 45% by weight to the whole weight of the resin coat layer.

DETAILED DESCRIPTION OF THE INVENTION

Figure 1:
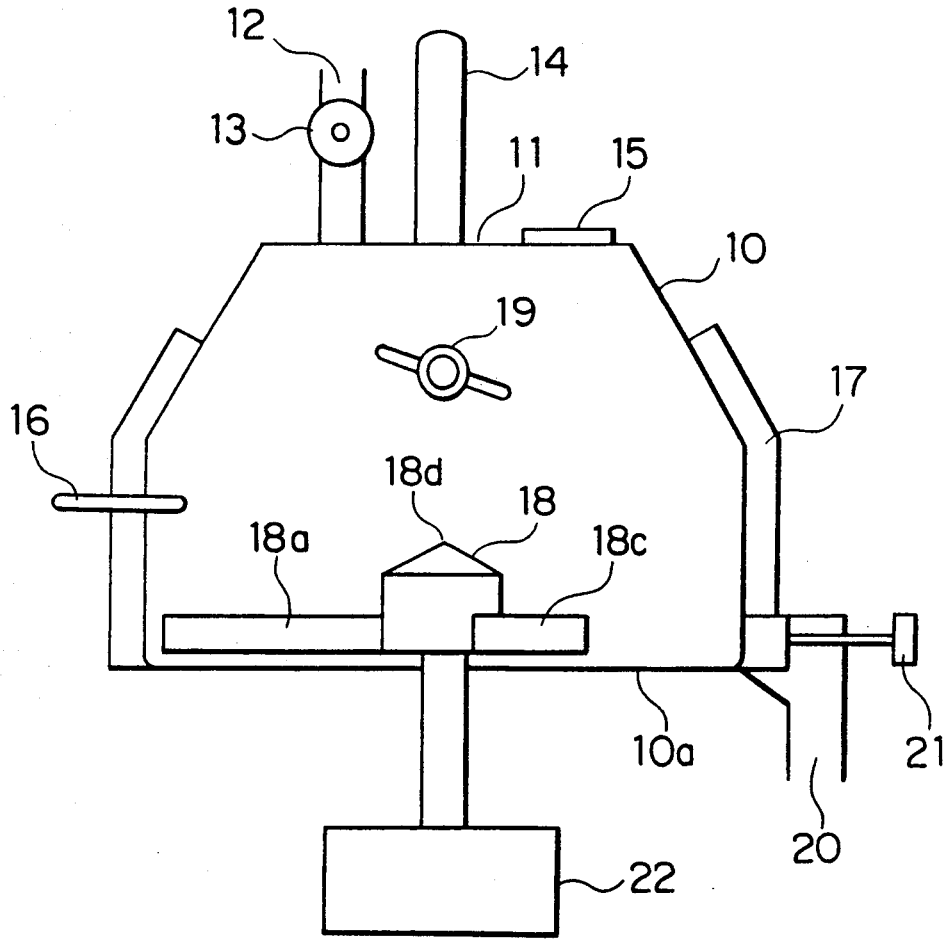
FIG. 1 is a schematic drawing showing a horizontally rotating blade-type mixer usable in the manufacture of the carrier of the invention.

Since the invention specifies the ratio of the carbon fluoride dispersed in the resin coat layer to be 5 to 45% by weight, the coating resin and the carbon fluoride are present as secondary aggregates in the initial stage of the mixing/stirring process thereof, and the secondary aggregates of the coating resin and the carbon fluoride are pluverized by being subjected to a mechanical impact force caused by the stirring in the process of forming a resin coat layer by having the secondary aggregate adhere to cover the surface of the core particle. Besides, the primary carbon fluoride particles are very finely pulverized as well to be so sufficiently mixed with the coating resin as to become uniformly dispersed and contained in the resin coat layer; i.e., to accelerate the formation of a coating resin-carbon fluoride complex. As a result, the dispersing uniformity of the carbon fluoride in the resin coat layer can be markedly improved.

The carbon fluoride used herein, when represented by CFx, is preferably one in which its fluorine content x is in the range of $0.05<x<0.5$. The use of such a carbon fluoride enables to provide an appropriate conductivity to the carrier, to make the carrier's resistivity range optimum so as to increase the solid image density.

The carbon fluoride is carbon monofluoride, polydicarbon monofluoride or polytetracarbon monofluoride, which is produced by heating at a high temperature a carbon source such as carbon black, crystalline graphite, petroleum coke, together with a fluorine gas, and is usually represented by CFx.

As the coating resin of the invention there may be used resins known as the coating resin for the carrier, which include styrene resins, acryl resins, styrene-acryl copolymer resins, vinyl resins, ethylene resins, rosin-modified resins, polyamide resins and polyester resins.

The most preferred among these resins is the styrene-acryl copolymer resin.

Examples of the styrene monomer for the styrene-acryl copolymer resin include styrene, o-methyl-styrene, m-methylstyrene, p-methyl-styrene, α-methyl-styrene, p-ethyl-styrene, 2,4-dimethyl-styrene, p-n-butyl-styrene, p-t-butyl-styrene, p-n-hexyl-styrene, p-n-octyl-styrene, p-n-octyl-styrene, p-n-nonyl-styrene, p-n-decyl-styrene, p-n-dodecyl-styrene, p-methoxystyrene, p-phenyl-styrene, p-chlorostyrene and 3,4-dichlorostyrene. These styrene monomers may be used in combination.

Examples of the acryl monomer for the styrene-acryl copolymer include acrylic acid, methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl 2-chloroacrylate, methacrylic acid, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate. These monomers may be used in combination.

The ratio by weight of the styrene monomer and the acryl monomer for copolymerization is preferably 9:1 to 1:9.

The styrene component has the effect of hardening the resin coat layer, while the acryl component has the effect of strengthening the resin coat layer. By discretionally adjusting the ratio of these monomers for copolymerization, it is possible to control the triboelectric chargeability of the carrier. The weight average molecular weight Mw of the styrene-acryl copolymer is preferably 30,000 to 200,000 from the standpoint of increasing the mechanical strength of the resin coat layer.

The core material particles for the carrier are preferably magnetic particles. The weight average particle size of the magnetic particles is preferably 20 to 200 μm and more preferably 30 to 120 μm in consideration of the triboelectric chargeability thereof with the toner and the adhesion thereof to the photoreceptor.

The weight average particle size of the carrier is a value obtained by measuring in a dry process with a microtrack Type 7981-OX, manufactured by LEEDS & NORTHROP Co.

As the magnetic particles there may be used a substance that is strongly magnetized by the magnetic field in the direction thereof, such as iron, ferrite and magnetite, in which the ferrite is a general term for iron-containing magnetic oxides which are not limited to spinel-type ferrites represented by the chemical formula: $MO.Fe_2O_3$, wherein M represents a divalent metal such as nickel, copper, zinc, manganese, magnesium and lithium.

The resistivity of the carrier is preferably $10^7$ to $10^{14}$ Ω·cm and more preferably $10^8$ to $10^{11}$Ω·cm from the viewpoint of improving the reproducibilities of characters, line drawings and solid images.

Subsequently, examples of the carrier producing method are explained.

The carrier of the invention is produced by coating the core particle with a resin, in which the formation of the resin coat layer is preferably performed in a dry process. The dry process is a process in which instead of using a coating liquid, powdery coating resin and core particles are mixed by stirring, and the mixture is subjected repeatedly to a mechanical impact force to thereby form a coating resin layer on the surface of the core material particle.

In an example of the carrier producing method of the invention, the core material particles, coating resin particles and carbon fluoride particles are uniformly mixed by stirring in an ordinary mixer-stirrer, and the obtained mixture is put in, e.g., an ordinary rotary blade-type mixer-stirrer device, in which the mixture is subjected repeatedly for 5 to 30 minutes to a mechanical impact force to thereby form a resin coat layer consisting of the coating resin and the carbon fluoride on the surface of the core material particles. It is preferable that the above process be performed in the presence of no liquid such as an organic solvent.

The average particle size of the carbon fluoride primary particles is preferably not more than 10 μm in view of faciliating the pulverization thereof by a mechanical impact force.

The average particle size of the coating resin is preferably not more than 1 μm in order to increase the adhesion thereof to the surface of the core material particles.

The amount range of the coating resin for mixing is preferably 0.3 to 3% by weight from the viewpoint of adjusting the resistivity of the carrier.

FIG. 1 is a drawing showing an example of the horizontally rotating-type mixer usable for producing the carrier, in which on the top cover 11 of a mixing/stirring pot 10 is provided a material supply inlet 12 having a supply valve 13, a filter 14 and a checking opening 15.

Figure 2:
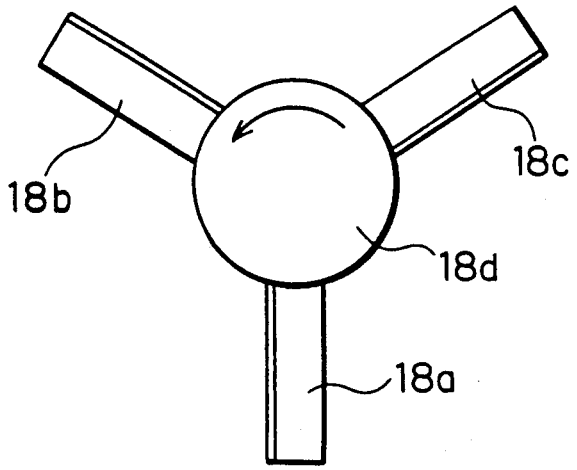
FIG. 2 is a plan view of a horizontally rotating body.
Figure 3:
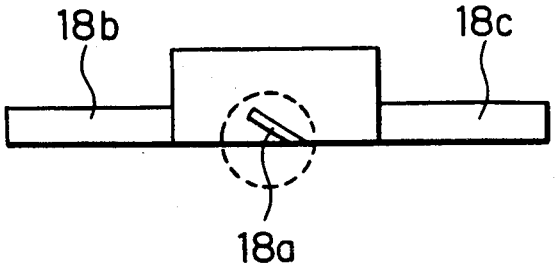
FIG. 3 is an elevational view of the horizontally rotating body.
Figure 4:
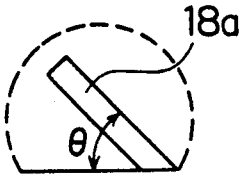
FIG. 4 is an enlarged elevational view of the horizontally rotating body.

The raw materials that have been supplied from material supply inlet 12 through supply valve 13 are stirred by rotating blades 18*a*, 18*b* and 18*c* of a horizontally rotating body driven by a motor 22, whereby a mechanical impact force is applied to the materials. The horizontally rotating body 18, as shown in FIG. 2, comprises a central portion 18*d* rotated in the direction of arrow and three rotary blades 18*a*, 18*b* and 18*c* which are symmetrically provided with respect to the central portion 18*d*. These rotary blades, as shown in FIGS. 3 and 4, each have a slope rising at an angle of θ slanted in the upward direction from the bottom 10*a* of the mixing/stirring pot 10. Therefore, the supplied materials are stirred up by these rotating blades. The stirred-up carrier materials run against the upper or lower obliqued internal wall of the mixing/stirring pot and then fall into the rotating range of rotary blades 18*a*, 18*b* and 18*c* of the horizontally rotating body 18. On the other hand, on top of the horizontally rotating body 18 is provided a vertically rotating body 19 having two rotary blades which vertically rotate to come into collision with the carrier materials that have bounced off the internal wall of mixing/stirrer pot 10. The vertically rotating body 19 functions to accelerate the stirring of the carrier materials and to prevent the materials from aggregating.

Thus, the carrier materials repeat collison with the horizontally rotating body 18, vertically rotating body 19 and the internal wall of mixing/stirring pot 10 or with one another thereby to be mechanically shocked, whereby the coating resin particles and carbon fluoride particles are extended over and sticked on the surface of the core particle and thus a resin coat layer is formed. The resin-coated carrier thus obtained is ejected through an ejection valve 21 open and taken out of a product outlet 20.

A jacket 17 functions as a heating means at the time of stirring the carrier materials and functions as a cooling means after completion of the stirring of the carrier materials. The external wall of the mixing/stirring pot 10 is covered with the jacket 17 up to about ¾ of its height, i.e., up to the level the vertically rotating body 19 is mounted. The materials' temperature is measured with a thermometer 16.

The vertically rotating body 19 is provided as needed; the horizontally rotating body 18 alone may be provided.

The carrier of the invention is mixed with a toner to compose a two-component developer. As for the mixing ratio, the toner concentration is preferably 1 to 10% by weight.

As the toner any type of toner may be used without any restriction; conventionally known toners are usable.

EXAMPLES

The invention is illustrated in detail by the following examples and comparative examples. The 'parts' hereinafter described means parts by weight.

EXAMPLE 1

| | |
|---|---|
| Core particles (spherical ferrite particles. average particle size: 80 μm) | 1000 parts |
| Coating resin (methyl methacrylate-styrene copolymer particles, copolymerization molar ratio 6:4, Mw = 130,000, Mw/Mn = 1.9, primary particles' weight average particle size: 0.1 μm) | 9 parts |
| Carbon fluoride (fluorine content x = 0.07, primary particles' weight average particle size: 1 μm) | 1 part |

The above carrier materials were put in a horizontally rotating-type mixer and mixed by stirring for 5 minutes at 30° C. under conditions of a horizontally rotating circumferential speed of 8 m/sec., and then stirred for 20 minutes at 60° C. to thereby produce a resin-coated carrier of which the carbon fluoride content is 1/(9+1), i.e., 10% weight.

EXAMPLE 2

| | |
|---|---|
| Core particles (the same as in Example 1) | 1000 parts |
| Coating resin (the same as in Example 1) | 8 parts |
| Carbon fluoride (the same as in Example 1) | 2 parts |

In the same manner as in Example 1, the above carrier materials were used to produce a resin-coated carrier of which the resin coat layer has a carbon fluoride content of 20% by weight.

EXAMPLE 3

| | |
|---|---|
| Core particles (the same as in Example 1) | 1000 parts |
| Coating resin (the same as in Example 1) | 6 parts |
| Carbon fluoride (the same as in Example 1) | 4 parts |

In the same manner as in Example 1, the above materials were used to produce a resin-coated carrier of which the resin coat layer has a carbon fluoride content of 40% by weight.

EXAMPLE 4

| | |
|---|---|
| Core particles (the same as in Example 1) | 1000 parts |
| Coating resin (methyl polymethacrylate | 9 parts |

-continued

| | |
|---|---|
| particles, primary particles' average particle size: 0.1 μm) | |
| Carbon fluoride (fluorine content x = 0.25, primary particles' average particle size: 1.5 μm) | 1 part |

In the same manner as in Example 1, the above materials were used to produce a resin-coated carrier of which the resin coat layer has a carbon fluoride content of 10% b weight.

EXAMPLE 5

| | |
|---|---|
| Core particles (the same as in Example 1) | 1000 parts |
| Coating resin (the same as in Example 4) | 8 parts |
| Carbon fluoride (the same as in Example 4) | 2 parts |

In the same manner as in Example 1, the above materials were used to produce a resin-coated carrier of which the resin coat layer has a carbon fluoride content of 20% by weight.

EXAMPLE 6

| | |
|---|---|
| Core particles (the same as in Example 1) | 1000 parts |
| Coating resin (the same as in Example 4) | 6 parts |
| Carbon fluoride (the same as in Example 4) | 4 parts |

In the same manner as in Example 1, the above materials were used to produce a resin-coated carrier of which the resin coat layer has a carbon fluoride content of 40% by weight.

EXAMPLE 7

| | |
|---|---|
| Core particles (the same as in Example 1) | 100 parts |
| Coating resin (the same as in Example 1) | 9 parts |
| Carbon fluoride (fluorine content x = 1.0, primary particles, weight average particles: 4.5 μm) | 1 part |

In the same manner as in Example 1, the above materials were used to produce a resin-coated carrier of which the resin coat layer has a carbon fluoride content of 10% by weight.

EXAMPLE 8

| | |
|---|---|
| Core particles (the same as in Example 1) | 100 parts |
| Coating resin (the same as in Example 1) | 8 parts |
| Carbon fluoride (the same as in Example 7) | 2 parts |

In the same manner as in Example 1, the above materials were used to produce a resin-coated carrier of which the resin coat layer has a carbon fluoride content of 20% by weight.

EXAMPLE 9

| | |
|---|---|
| Core particles (the same as in Example 1) | 1000 parts |
| Coating resin (the same as in Example 1) | 6 parts |
| Carbon fluoride (the same as in Example 7) | 4 parts |

In the same manner as in Example 1, the above materials were used to produce a resin-coated carrier of which the resin coat layer has a carbon fluoride content of 40% by weight.

EXAMPLE 10

| | |
|---|---|
| Core particles (the same as in Example 1) | 1000 parts |
| Coating resin (the same as in Example 1) | 9 parts |
| Carbon fluoride (fluorine content x = 0.01, primary particle's weight average particle size: 12 μm) | 1 part |

In the same manner as in Example 1, the above materials were used to produce a resin-coated carrier of which the resin coat layer has a carbon fluoride content of 10% by weight.

EXAMPLE 11

| | |
|---|---|
| Core particles (the same as in Example 1) | 1000 parts |
| Coating resin (fine particles of polymethyl methacrylate, primary particle's weight average particle size: 1.5 μm) | 9 parts |
| Carbon fluoride (fluorine content x = 0.1, primary particle's weight average particle size: 12 μm) | 1 part |

In the same manner as in Example 1, the above materials were used to produce a resin-coated carrier of which the resin coat layer has a carbon fluoride content of 10% by weight.

COMPARATIVE EXAMPLE 1

Two grams of carbon fluoride (fluorine content x=0.07, BET specific surface area: 87 $m^2/g$) were added to a solution of 18 g of the same methyl methacrylate-styrene copolymer as in Example 1 dissolved in 400 ml of a toluene-methanol mixed solvent (ratio by volume of 9:1), and this mixture was sufficiently dispersed by ultrasonic waves, whereby a coating liquid was prepared.

This coating liquid was coated by a fluidized bed coating device on the surface of 2 kg of the same core material particles as in Example 1 to thereby produce a comparative resin-coated carrier of which the resin coat layer has a carbon fluoride content of 10% by weight.

COMPARATIVE EXAMPLE 2

| | |
|---|---|
| Core particles (the same as in Example 1) | 1000 parts |
| Coating resin (the same as in Example 1) | 9.6 parts |
| Carbon fluoride (the same as in Example 1) | 0.4 part |

In the same manner as in Example 1, the above materials were used to produce a comparative resin-coated carrier of which the resin coat layer has a carbon fluoride content of 4% by weight.

COMPARATIVE EXAMPLE 3

| | |
|---|---|
| Core particles (the same as in Example 1) | 1000 parts |
| Coating resin (the same as in Example 1) | 9.6 parts |
| Carbon fluoride (the same as in Example 7) | 0.4 part |

In the same manner as in Example 1, the above materials were used to produce a comparative resin-coated carrier of which the resin coat layer has a carbon fluoride content of 4% by weight.

COMPARATIVE EXAMPLE 4

| | |
|---|---|
| Core particles (the same as in Example 1) | 1000 parts |
| Coating resin (the same as in Example 1) | 5 parts |
| Carbon fluoride (the same as in Example 1) | 5 parts |

In the same manner as in Example 1, the above materials were used to produce a comparative resin-coated carrier of which the resin coat layer has a carbon fluoride content of 50% by weight.

COMPARATIVE EXAMPLE 5

| | |
|---|---|
| Core particles (the same as in Example 1) | 1000 parts |
| Coating resin (the same as in Example 1) | 5 parts |
| Carbon fluoride (the same as in Example 7) | 5 parts |

In the same manner as in Example 1, the above materials were used to produce a comparative resin-coated carrier of which the resin coat layer has a carbon fluoride content of 50% by weight.

| Practical copyinq test | |
|---|---|
| Polyester resin | 100 parts |
| Carbon black | 10 parts |
| Low-molecular polypropylene | 3 parts |
| Ethylene-bis-stearoylamide | 2 parts |

The above materials were mixed, kneaded, pulverized and classified by using a ball mill to thereby produce colored particles having an average particle size of 10 μm. Next, the colored particles were mixed with a hydrophobic silica powder in a proportion of 0.4% by weight to thereby produce a toner.

The carrier produced in each of the above examples and comparative examples was so mixed with the above toner as to have a toner content of 4% by weight to thereby prepare each two-component developer.

Each two-component developer prepared in above was used to perform copy image forming tests by using an electrophotographic copier U-Bix 6040, manufactured by KONICA Corporation, to examine the following items. The results are shown in Tables 1 and 2.

Counter-Polar Toner Ratio

The mass ratio of the toner charged to a polarity counter to the polarity to which the toner is to be essentially charged (the mass ratio of the positively charged toner in a negatively charged developer) was found by using a charged amount distribution measuring instrument 'E-Spart Analyzer', manufactured by Hosokawa Micron Co.

Fog

A relative density of a copied image to the original's white background density set at 0.0 was measured by using a SAKURA Densitometer, manufactured by KONICA Corporation, and the measured relative density was rated as G for less than 0.01, N for 0.01 or more and P for 0.02 or more.

Solid image density

The white background density of a copy image was set at 0.0 and the relative solid image density thereto of the copy image corresponding to an original's solid image density of 1.2 was measured with a SAKURA Densitometer, manufactured by KONICA Corporation, and the measured relative density was rated as G for 1.2 or more, N for 1.0 to 1.2 and P for less than 1.0.

Durability

The relative solid image density to the while background density set at 0.0 of a copy image was measured with a SAKURA Densitometer, manufactured by KONICA Corporation, and the durability of each sample was evaluated in terms of the number of image copies obtained by the time when the solid image density comes to 1.0 or lower.

Permanent Welding of Toner Particles to Carrier Surface

The surface of the carrier that appeared after blowing the toner off the developer was observed through a scanning electron microscope, and the permanent welding of toner particles to the carrier surface was rated as P when the toner was found sticking on the carrier surface and as G when no toner was found at all on the carrier surface.

Amount of Triboelectric Charge of the Toner

It was found according to an ordinary blow-off method.

Resistivity of the Carrier

It was calculated in terms of the current value obtained 30 seconds after starting the impression of 100 V to the carrier layer of 0.5 cm under conditions of an electrode area of 1 $cm^2$ and a load of 1 kg.

For the above measurements the produced carriers were used at the time of starting the running test, and after starting the running test the carriers cleared of the toner in the blow-off manner was used.

TABLE 1

| | Counter-polar toner rate | | Fog | | Solid image density | | Durability | Permanent welding |
|---|---|---|---|---|---|---|---|---|
| | At start | After 200,000 copies | At start | After 200,000 copies | At start | After 200,000 copies | (number of copies) | of toner particles to carrier surface |
| Example 1 | 4% | 4% | G | G | G | G | Over 250,000 | None till 250,000th copy |
| Example 2 | 2% | 3% | G | G | G | G | Over 250,000 | None till 250,000th copy |
| Example 3 | 4% | 4% | G | G | G | G | Over 250,000 | None till 250,000th copy |
| Example 4 | 2% | 4% | G | G | G | G | Over 250,000 | None till 250,000th copy |
| Example 5 | 3% | 4% | G | G | G | G | Over 250,000 | None till 250,000th copy |
| Example 6 | 4% | 4% | G | G | G | G | Over 250,000 | None till 250,000th copy |
| Example 7 | 4% | 3% | G | G | G | G | Over 250,000 | None till 250,000th copy |
| Example 8 | 3% | 4% | G | G | G | G | Over 250,000 | None till 250,000th copy |
| Example 9 | 4% | 4% | G | G | G | G | Over 250,000 | None till 250,000th copy |
| Example 10 | 5% | 12% | G | G | G | G | Over 200,000 | None till 200,000th copy |
| Example 11 | 5% | 12% | G | N | G | G | Over 200,000 | None till 200,000th copy |
| Comp. ex. 1 | 14% | 21% | P | P | G | P | 70,000 | Occurred at 70,000th copy |
| Comp. ex. 2 | 4% | 18% | G | P | N | P | 60,000 | Occurred at 100,000th copy |
| Comp. ex. 3 | 6% | 17% | N | P | G | N | 60,000 | Occurred at 100,000th copy |
| Comp. ex. 4 | 12% | 20% | P | P | N | N | 90,000 | Occurred at 100,000th copy |
| Comp. ex. 5 | 11% | 23% | P | P | N | N | 90,000 | Occurred at 100,000th copy |

TABLE 2

| | Amount of triboelectric charge of toner | | Resistivity of carrier | |
|---|---|---|---|---|
| | At start | After 200,000 copies | At start | After 200,000 copies |
| Example 1 | −23 μC/g | −21 μC/g | $7 \times 10^{10}$ Ω.cm | $4 \times 10^{10}$ Ω.cm |
| Example 2 | −22 μC/g | −21 μC/g | $8 \times 10^{9}$ Ω.cm | $1 \times 10^{10}$ Ω.cm |
| Example 3 | −21 μC/g | −21 μC/g | $8 \times 10^{9}$ Ω.cm | $6 \times 10^{9}$ Ω.cm |
| Example 4 | −22 μC/g | −21 μC/g | $2 \times 10^{9}$ Ω.cm | $5 \times 10^{9}$ Ω.cm |
| Example 5 | −23 μC/g | −21 μC/g | $7 \times 10^{9}$ Ω.cm | $4 \times 10^{10}$ Ω.cm |
| Example 6 | −22 μC/g | −21 μC/g | $8 \times 10^{9}$ Ω.cm | $1 \times 10^{10}$ Ω.cm |
| Example 7 | −21 μC/g | −21 μC/g | $8 \times 10^{12}$ Ω.cm | $6 \times 10^{12}$ Ω.cm |
| Example 8 | −22 μC/g | −21 μC/g | $2 \times 10^{12}$ Ω.cm | $5 \times 10^{12}$ Ω.cm |
| Example 9 | −22 μC/g | −21 μC/g | $4 \times 10^{12}$ Ω.cm | $5 \times 10^{12}$ Ω.cm |
| Example 10 | −23 μC/g | −21 μC/g | $2 \times 10^{9}$ Ω.cm | $4 \times 10^{10}$ Ω.cm |
| Example 11 | −22 μC/g | −21 μC/g | $1 \times 10^{9}$ Ω.cm | $4 \times 10^{10}$ Ω.cm |
| Comp. ex. 1 | −16 μC/g | −10 μC/g | $7 \times 10^{8}$ Ω.cm | $8 \times 10^{12}$ Ω.cm |
| Comp. ex. 2 | −20 μC/g | −14 μC/g | $5 \times 10^{9}$ Ω.cm | $7 \times 10^{12}$ Ω.cm |
| Comp. ex. 3 | −15 μC/g | −13 μC/g | $1 \times 10^{13}$ Ω.cm | $3 \times 10^{13}$ Ω.cm |
| Comp. ex. 4 | −18 μC/g | −14 μC/g | $9 \times 10^{8}$ Ω.cm | $6 \times 10^{7}$ Ω.cm |
| Comp. ex. 5 | −18 μC/g | −13 μC/g | $1 \times 10^{12}$ Ω.cm | $6 \times 10^{12}$ Ω.cm |

As is apparent from Tables 1 and 2, each of the two-component developers comprising the carriers produced by the method of the invention has so small a counter-polar toner generating rate as to have a good chargeability, and therefore forms no fog on image copies and enables to provide a high solid image density-having copy image. Further, a low-energy carbon fluoride is so uniformly dispersed on the surface of the carrier as to extremely lessen the time changes in the amount of triboelectric charge of the toner and the resistivity of the carrier, so that the developer keeps its developability stable to have a remarkably high durability.

Accordingly, it is apparent that the carriers of the invention are markedly superior to the comparative carriers.

What is claimed is:

1. A method for producing a carrier for an electrostatic image developer comprising:

stirring a mixture of core particles, styrene-acryl polymer resin particles having an average primary particle size of not more than 1 μm, and carbon fluoride particles having an average particle size not more than 10 μm, in the presence of no liquid, to form a resin coating layer on the surface of each core particle, wherein said resin coating layer contains said carbon fluoride dispersed therein, in a ratio of from 5% to 45% by weight of said resin coat layer.

2. The method of claim 1, wherein said carbon fluoride is a compound represented by CFx in which x is within the range of from 0.05 to 0.5.

3. The method of claim 1, wherein said core particle comprises a magnetic material.

4. The method of claim 1, wherein said core particles have a weight average particle size of from 20 μm to 200 μm.

5. The method of claim 1, wherein an amount of said resin particles is 0.3% to 3% by weight of said core particles.

6. The method of claim 1, wherein said mixture is stirred by a stirring apparatus having a vertically rotating body.

* * * * *